US010851591B2

(12) United States Patent
Winslow

(10) Patent No.: US 10,851,591 B2
(45) Date of Patent: Dec. 1, 2020

(54) ACTUATION APPARATUS OF A DIRECTIONAL DRILLING MODULE

(71) Applicant: Halliburton Energy Services, Inc., Houston, TX (US)

(72) Inventor: Daniel Martin Winslow, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 276 days.

(21) Appl. No.: 15/761,646

(22) PCT Filed: Oct. 12, 2015

(86) PCT No.: PCT/US2015/055162
§ 371 (c)(1),
(2) Date: Mar. 20, 2018

(87) PCT Pub. No.: WO2017/065741
PCT Pub. Date: Apr. 20, 2017

(65) Prior Publication Data

US 2018/0340373 A1 Nov. 29, 2018

(51) Int. Cl.
*E21B 7/06* (2006.01)

(52) U.S. Cl.
CPC ..... *E21B 7/062* (2013.01)

(58) Field of Classification Search
CPC ..... E21B 7/062; E21B 7/06
See application file for complete search history.

(56) References Cited

U.S. PATENT DOCUMENTS

| | | | | |
|---|---|---|---|---|
| 4,597,454 | A | 7/1986 | Schoeffler | |
| 5,113,953 | A | 5/1992 | Noble | |
| 5,168,941 | A | 12/1992 | Krueger et al. | |
| 5,520,255 | A | 5/1996 | Barr et al. | |
| 6,116,354 | A | 9/2000 | Buytaert | |
| 6,158,529 | A | 12/2000 | Dorel | |
| 6,234,259 | B1 * | 5/2001 | Kuckes | E21B 7/062 175/61 |
| 6,244,361 | B1 | 6/2001 | Comeau et al. | |
| 7,188,685 | B2 | 3/2007 | Downton et al. | |
| 7,866,415 | B2 | 1/2011 | Peters | |
| 2012/0285746 | A1 * | 11/2012 | Kvalvik | E21B 7/06 175/74 |

FOREIGN PATENT DOCUMENTS

| | | | |
|---|---|---|---|
| WO | 2012152914 | A2 | 11/2012 |
| WO | 2013009285 | A1 | 1/2013 |
| WO | 2014137330 | A1 | 9/2014 |

OTHER PUBLICATIONS

PCT International Search Report and Written Opinion dated Jul. 12, 2016, issued in corresponding application No. PCT/US2015/055162 filed on Oct. 12, 2015, 15 pgs.

* cited by examiner

*Primary Examiner* — Caroline N Butcher
(74) *Attorney, Agent, or Firm* — Chamberlain Hrdlicka

(57) ABSTRACT

An actuation apparatus includes a housing comprising a housing bore extending through the housing, an adjustment shaft comprising an adjustment shaft bore extending through the adjustment shaft, the adjustment shaft positioned at least partially within housing bore, and a steering shaft positioned at least partially within the adjustment shaft bore and rotatable with respect to the adjustment shaft.

20 Claims, 5 Drawing Sheets

ACTUATION APPARATUS OF A DIRECTIONAL DRILLING MODULE

BACKGROUND

Directional borehole operations, such as directional drilling, involve varying or controlling the direction of a downhole tool (e.g., a drill bit) in a wellbore to direct the tool towards a desired target destination. In directional drilling, for example, the direction of a drill bit is controlled to direct the bit, and the resultant wellbore, towards a desired target destination.

Various techniques have been used for adjusting the direction of a tool string in drilling a borehole. Slide drilling, for example, may be performed using a downhole motor and a bent housing to selectively change the direction in which the borehole is being drilled. Normally, the entire drill string, including the downhole motor and bent housing, is rotated from the surface, for a zero net change in direction (nominally straight drilling). The direction of drilling may be changed by using the downhole motor alone to rotate the bit while drill string rotation is halted, such that the bent housing deflects the bit in the desired direction. When the desired directional change is achieved, rotation of the string from the surface may be resumed.

Slide drilling systems may have challenges related to halting drill string rotation. For example, a non-rotating drill string is subject to buckling in the wellbore and reduced hole cleaning efficiency.

In contrast to slide drilling systems, directional drilling systems typically have an adjustable housing angle that may be dynamically controlled while drilling to effectively steer the borehole being drilled. This allows the entire drill string to continue rotating while changing the direction of the borehole. By maintaining drill string rotation, directional drilling systems overcome various deficiencies of slide drilling.

An example of a tool for controlling deflection in a directional drilling system (i.e. a rotary steerable module) typically includes a shaft that rotates with the drill string surrounded by a housing that deflects the shaft thereby pointing the bit, an internally rotatable articulated coupling of two shafts (Point the Bit), or a fully rotating or partially geo-stationary device with radial push pads/gauges. By deflecting the shaft, the direction of the downhole end of the shaft is changed to also change the direction of drilling of the drill bit.

BRIEF DESCRIPTION OF THE DRAWINGS

For a detailed description of the embodiments of the invention, reference will now be made to the accompanying drawings in which.

The illustrated figures are only exemplary and are not intended to assert or imply any limitation with regard to the environment, architecture, design, or process in which different embodiments may be implemented.

DETAILED DESCRIPTION

Figure 1:
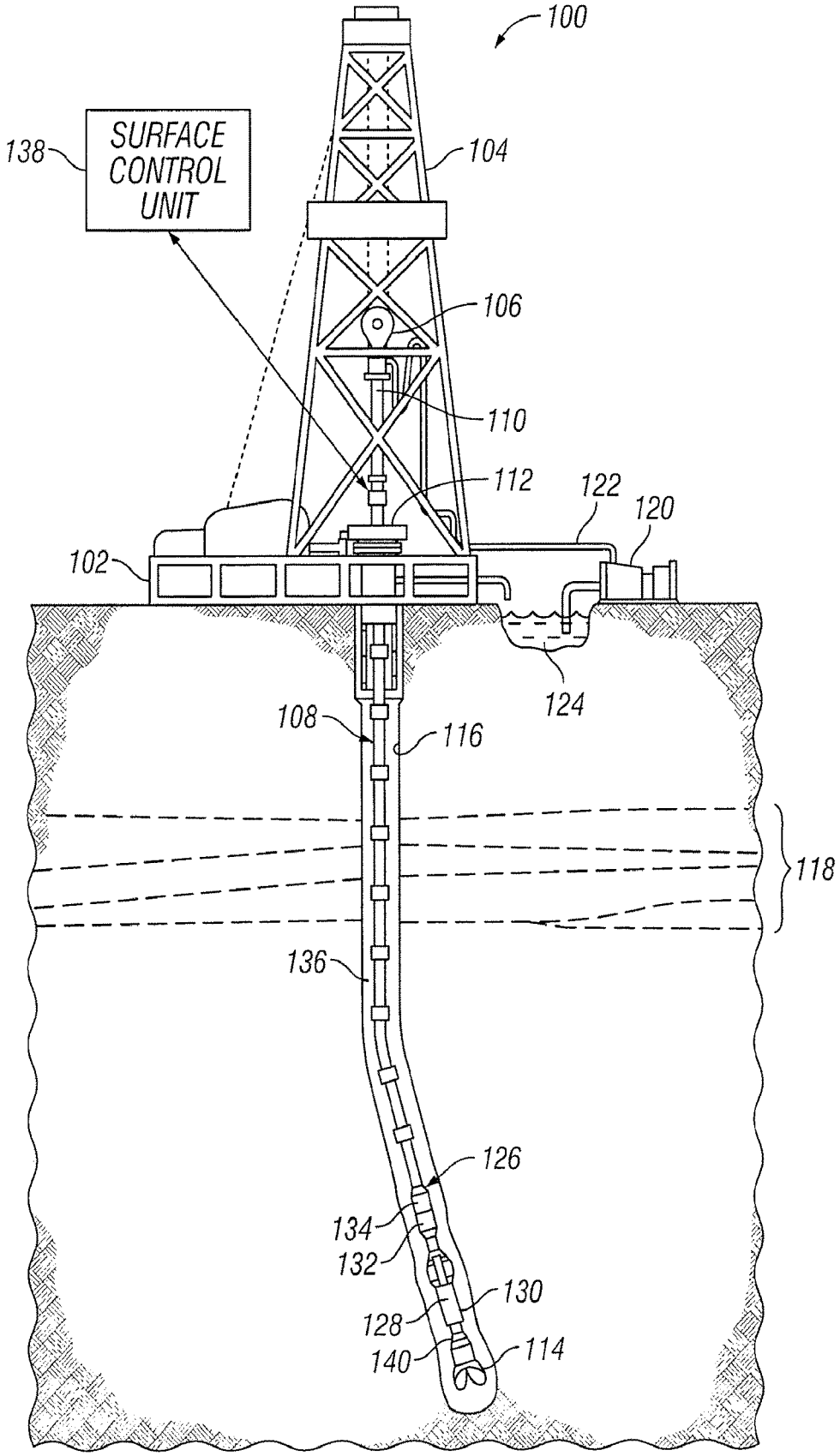
FIG. 1 shows schematic view of a wellbore environment in accordance with one or more embodiments of the present disclosure.

FIG. 1 is a schematic view of a well system operating a downhole drilling assembly that can embody principles of the present disclosure. The system of the present disclosure will be specifically described below such that the system is used to direct a drill bit to drill a wellbore within a well, such as a well subsea or on land. Further, it will be understood that the present disclosure is not limited to only drilling an oil well. The present disclosure also encompasses natural gas wellbores or hydrocarbon wellbores in general. Further, the present disclosure may be used for production, monitoring, or injection in relation to the recovery of hydrocarbons or other materials from the subsurface. This could also include geothermal wellbores intended to provide a source of heat energy instead of hydrocarbons.

Accordingly, a tool string 126 is shown in FIG. 1 disposed in a directional borehole 116. The tool string 126 including a directional drilling module 128 in accordance with various embodiments. A drilling platform 102 supports a derrick 104 having a traveling block 106 for raising and lowering a drill string 108. A kelly 110 supports the drill string 108 as the drill string 108 is lowered through a rotary table 112. In some embodiments, a topdrive is used to rotate the drill string 108 in place of the kelly 110 and the rotary table 112. A drill bit 114 is positioned at the downhole end of the tool string 126, and, in one or more embodiments, may be driven by a downhole motor (not shown) positioned in the tool string 126 uphole of the rotary steering tool 128 and/or rotation of the drill string 108 from the surface. As the bit 114 rotates, the bit 114 creates the borehole 116 that passes through various formations 118. A pump 120 circulates drilling fluid through a feed pipe 122 and downhole through the interior of drill string 108, through orifices in drill bit 114, back to the surface via the annulus 136 around drill string 108, and into a retention pit 124. The drilling fluid transports cuttings from the borehole 116 into the pit 124 and aids in maintaining the integrity of the borehole 116.

The tool string 126 may include one or more logging-while-drilling ("LWD")/measurement-while-drilling ("MWD") tools 132 that collect measurements relating to various formation properties as well as the position of the bit 114 and various other drilling conditions as the bit 114 extends the borehole 108 through the formations 118. The MWD tool 132 may include a device for measuring formation resistivity, a gamma ray device for measuring formation gamma ray intensity, devices for measuring the inclination and azimuth of the tool string 126, pressure sensors for measuring drilling fluid pressure, temperature sensors for measuring borehole temperature, etc.

The tool string 126 may also include a telemetry module 134. The telemetry module 134 receives data provided by the various sensors of the tool string 126 (e.g., sensors of the MWD tool 132), and transmits the data to a surface control unit 138. Similarly, data provided by the surface control unit 138 is received by the telemetry module 134 and transmitted to the tools (e.g, MWD tool 132, rotary steering tool 128, etc.) of the tool string 126. In some embodiments, mud pulse telemetry, wired drill pipe, acoustic telemetry, or other telemetry technologies know in the art may be used to provide communication between the surface control unit 138 and the telemetry module 134.

The directional drilling module 128 is configured to change the direction of the tool string 126 and/or the drill bit 114, such as based on information indicative of tool 128 orientation and a desired direction of the tool string 126. The directional drilling module 128 includes a housing 130 disposed about a steerable shaft 140. In this embodiment, the steerable shaft 140 transfers rotation through the directional drilling module 128. A deflection or cam assembly surrounding the shaft 140 is rotatable within the rotation resistant housing 130 to orient the cam assembly such that the shaft 140 can be deflected by movement of the cam assembly. Some embodiments of the directional drilling module 128 include a direction sensor (e.g., a magnetometer, gyroscope, accelerometer, etc.) for determining an azimuth to a reference direction (e.g., magnetic north), and based on the azimuth and a desired direction, the directional drilling module 128 determines a suitable orientation of the deflection sleeve to steer the tool string 126 in the desired direction.

Figure 2:
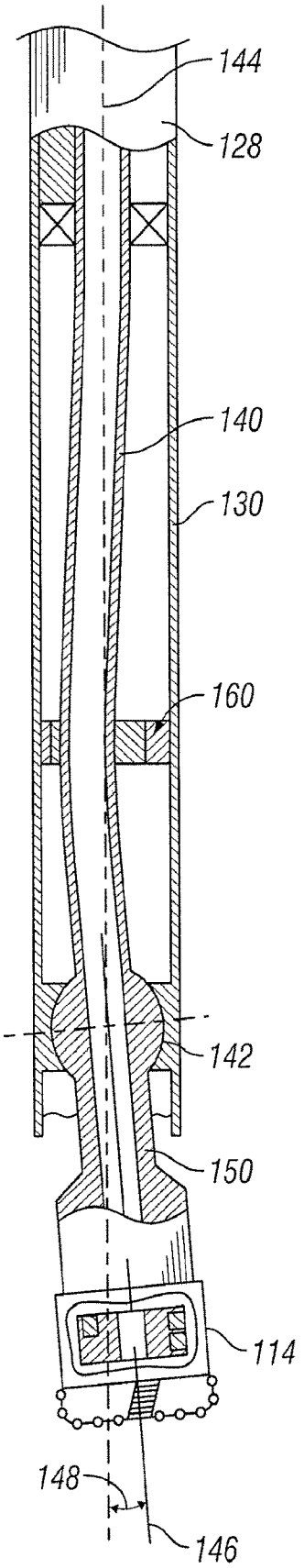
FIG. 2 shows a cross-sectional view of a directional drilling module for drilling a deviated borehole in accordance with one or more embodiments of the present disclosure.

Referring now to FIG. 2, a cross-sectional view of a directional drilling module 128 for drilling a deviated borehole in accordance with one or more embodiments of the present disclosure is shown. In this embodiment, the directional drilling module 128 includes a rotating shaft 140 within a housing 130. Radial deflection of the rotating shaft 140 within the housing 130 by a cam assembly 160 causes the lower end of the shaft 140 to pivot about a spherical bearing system 142. The intersection of the central axis 144 of the housing 130 and the central axis 146 of the pivoted shaft 140 below the spherical bearing system 142 defines a bend or angle 148 for directional drilling purposes. While steering, the angle 148 is maintained in a desired toolface and bend angle by the cam assembly 160. To drill straight, the cam assembly 160 is arranged so that the deflection of the shaft 140 is relieved and the central axis 146 of the shaft 140 below the spherical bearing system 124 is in line with the central axis 144 of the housing 130.

Figure 3:
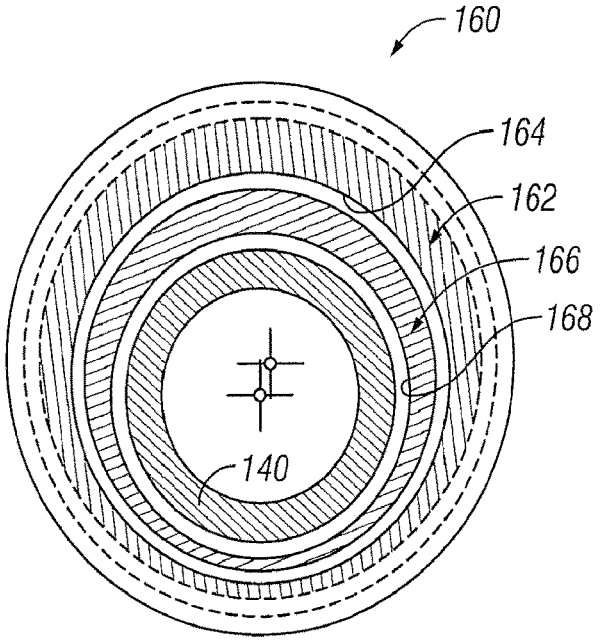
FIG. 3 shows a cross-sectional view of a cam assembly of a directional drilling module in accordance with one or more embodiments of the present disclosure.

FIG. 3 shows a cross-sectional view of the cam assembly 160. The cam assembly 160 includes an outer ring 162 and an inner ring 166. The outer ring 162 has an eccentric hole 164 formed through the outer ring 162, and the inner ring 166 also has an eccentric hole 168 formed through the inner ring 166. The inner ring 166 is then positioned (e.g., rotatably positioned) within the eccentric hole 164 formed of the outer ring 162. Further, the shaft 140 may be positioned and extend through the eccentric hole 168 of the inner ring 166 such that the shaft 140 is rotatable within the eccentric hole 168.

An actuation apparatus (discussed more below) is provided to control the orientation of the outer ring 162 and the inner ring 166 with respect to each other and/or relative to the housing 130. By orienting the outer ring 162 relative to the inner ring 166 in relation to the orientation of the housing 130, deflection of the rotating shaft 140 is controlled as the shaft 140 passes through the cam assembly 160. The deflection of the shaft 140 can be controlled in any direction and any magnitude within the limits of the cam assembly 160. This shaft deflection above the spherical bearing system causes the lower portion of the rotating shaft 150 below the spherical bearing assembly 142 to pivot in the direction opposite the shaft deflection and in proportion to the magnitude of the shaft deflection. For the purposes of directional drilling, the angle 148 may occur within the spherical bearing assembly 120 at the intersection of the central axis 144 of the housing 130 and the central axis 146 of the lower portion of the rotating shaft 160 below the spherical bearing assembly 142. The bend angle is the angle between the two central axes 144 and 146. The pivoting of the lower portion of the rotating shaft 150 causes the bit 114 to tilt in the intended manner to drill a deviated borehole.

Figure 4:
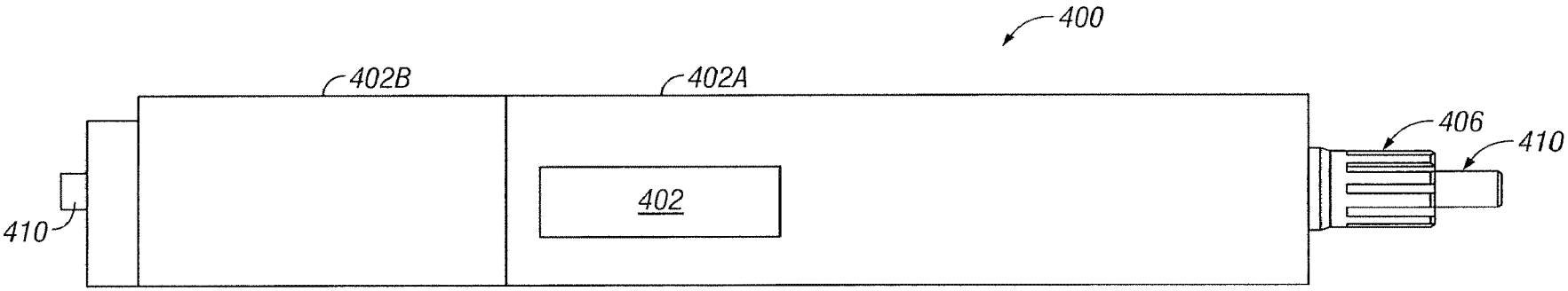
FIG. 4 shows a side view of the actuation apparatus in accordance with one or more embodiments of the present disclosure.
Figure 5:
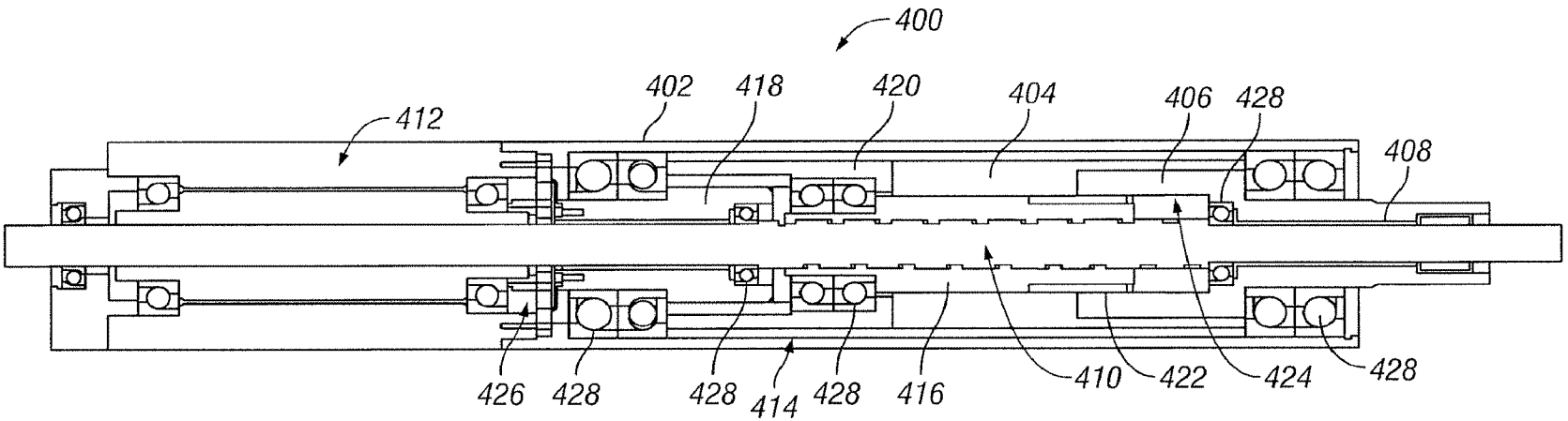
FIG. 5 shows a cross-sectional view of an actuation apparatus in accordance with one or more embodiments of the present disclosure.
Figure 7:
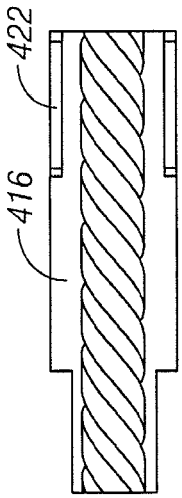
FIG. 7 shows a cross-sectional view of a sleeve of an actuation apparatus in accordance with one or more embodiments of the present disclosure.
Figure 6:
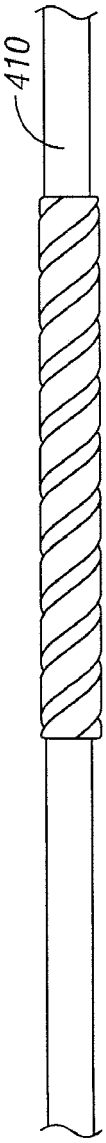
FIG. 6 shows a side view of a steering shaft of an actuation apparatus in accordance with one or more embodiments of the present disclosure.
Figure 8:
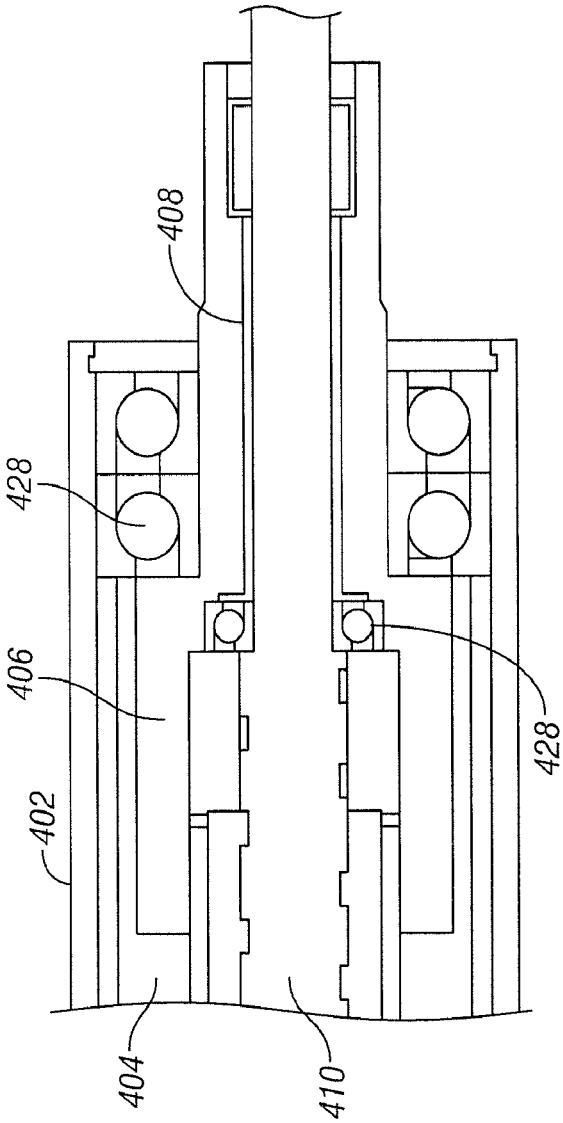
FIG. 8 shows a detailed cross-sectional view of an actuation apparatus in accordance with one or more embodiments of the present disclosure.
Figure 9:
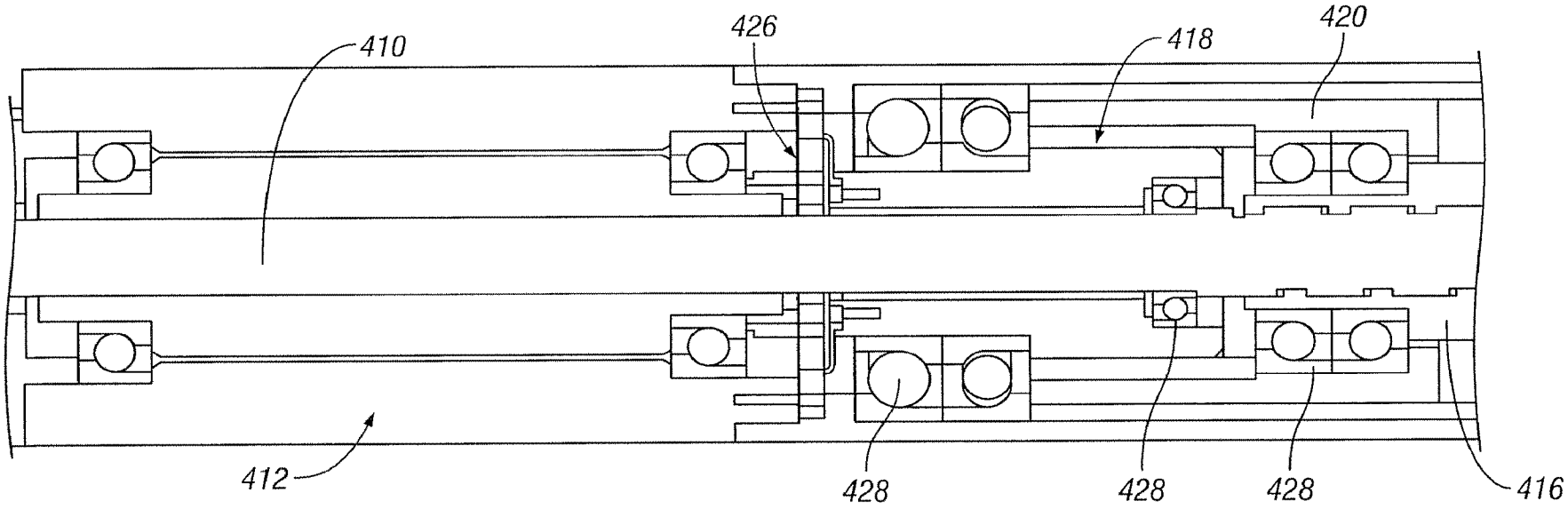
FIG. 9 shows another detailed cross-sectional view of an actuation apparatus in accordance with one or more embodiments of the present disclosure.

Referring now to FIGS. 4-9, multiple views of an actuation apparatus 400 for use with a directional drilling module in accordance with one or more embodiments of the present disclosure are shown. In particular, the actuation apparatus 400 may be used with a cam assembly 160 of a directional drilling module 128, such as to rotate one or more rings of the cam assembly with respect to each other. Accordingly, FIG. 4 shows a side view of the actuation apparatus 400, FIG. 5 shows a cross-sectional view of the actuation apparatus 400, FIG. 6 shows a side view of a steering shaft 410 of the actuation apparatus 400, FIG. 7 shows a cross-sectional view of a sleeve 416 of the actuation apparatus 400, FIG. 8 shows a detailed cross-sectional view of an end of the actuation apparatus 400, and FIG. 9 shows another detailed cross-sectional view of another end of the actuation apparatus 400.

The actuation apparatus 400 includes a housing 402 that has a bore 404 formed within and extending through the housing 402. In this embodiment, the housing 402 may be formed from one or more parts or components, such as a first housing 402A and a second housing 402B coupled to each other, or may be formed as a single component.

The actuation apparatus 400 then includes one or more shafts, such as at least partially positioned within the bore 404 of the housing 402. For example, an adjustment shaft 406 that has a bore 408 formed within and extending through the adjustment shaft 406 is at least partially positioned within the bore 404 of the housing 402. Further, a steering shaft 410 is positioned within the bore 404 of the housing 402, and more particularly positioned within the bore 408 of the adjustment shaft 406. The steering shaft 410 and the adjustment shaft 406 may be rotatable with respect to the housing 402, and the steering shaft 410 and the adjustment shaft 406 may be rotatable with respect to each other.

In one or more embodiments, a motor 412 may be operably coupled to the steering shaft 410 and/or the adjustment shaft 406 to rotate the steering shaft 410 and the adjustment shaft 406. The motor 412 may be an electric motor, mechanical motor, magnetic motor (e.g., permanent magnet motor), hydraulic motor, and/or any other type of motor known in the art.

A motion assembly 414 may then be operably coupled between the motor 412 and the steering shaft 410 and/or the adjustment shaft 406 to enable the motor 412 to rotate the adjustment shaft 406 with respect to the steering shaft 410. In this embodiment, the motion assembly 414 includes a sleeve 416, a driver 418, and a nut 420, and the motion assembly 414 is positioned, at least partially, within the bore 404 of the housing 402. The steering shaft 410 may extend through the motion assembly 414 such that the sleeve 416, the driver 418, and the nut 420 are positioned about the steering shaft 410.

The sleeve 416 rotationally engages with the steering shaft 410 such that the sleeve 416 is rotatable with respect to the steering shaft 410. For example, the sleeve 416 and the steering shaft 410 may be threadedly engaged with each other (e.g., helically coupled using a helical spline or thread) such that rotation between the sleeve 416 and the steering shaft 410 enables the sleeve 416 and the steering shaft 410 to move axially with respect to each other. Further, the sleeve 416 and the adjustment shaft 406 may be rotationally linked with each other such that the sleeve 416 and the adjustment shaft 406 rotate with each other (e.g., at the same rate). For example, the sleeve 416 and the adjustment shaft 406 may include one or more splines 422 and corresponding slots 424 formed therebetween such that rotation is translated between the sleeve 416 and the adjustment shaft 406 through the spline 422 and the corresponding slot 424. The sleeve 416 and the adjustment shaft 406, thus, may also move axially with respect to each other.

The motor 412 is used to axially move the sleeve 416 with respect to the adjustment shaft 406 and/or the steering shaft 410. For example, the driver 418 and the nut 420 are operably coupled between the motor 412 and the sleeve 416 to move the sleeve 416 with respect to the adjustment shaft 406 and/or the steering shaft 410. The driver 418 is coupled to the motor 412 such that the motor 412 is able to rotate the driver 418. In one embodiment, a gear reduction mechanism 426, such as a strain wave gear (e.g., Harmonic Drive), may be used to facilitate rotating the driver 418 with the motor 412.

The driver 418 and the nut 420 may be threadedly engaged with each other such that rotation between the driver 418 and the nut 420 enables the driver 418 and the nut 420 to move axially with respect to each other. Further, the nut 420 and the sleeve 416 may be axially linked with each other such that axial movement of the nut 420 also axially moves the sleeve 416. The nut 420 and the sleeve 416 are able to rotate with respect to each other. For example, as shown, one or more bearing assemblies 428 may be positioned between the nut 420 and the sleeve 416 to facilitate rotation between the nut 420 and the sleeve 416.

The driver 418 may be rotatable with respect to the housing 402 and/or the steering shaft 410. One or more bearing assemblies 428 may be positioned between the driver 418 and the housing 402 to facilitate rotation between the driver 418 and the housing 402, and one or more bearing assemblies 428 may be positioned between the driver 418 and the steering shaft 410 to facilitate rotation between the driver 418 and the steering shaft 410. Further, the adjustment shaft 406 may be rotatable with respect to the housing 402 and/or the steering shaft 410. One or more bearing assemblies 428 may be positioned between the adjustment shaft 406 and the housing 402 to facilitate rotation between the adjustment shaft 406 and the housing 402, and one or more bearing assemblies 428 may be positioned between the adjustment shaft 406 and the steering shaft 410 to facilitate rotation between the adjustment shaft 406 and the steering shaft 410.

As mentioned above, the steering shaft 410 and the adjustment shaft 406 may be rotatable with respect to the housing 402, and the steering shaft 410 and the adjustment shaft 406 may be rotatable with respect to each other. Accordingly, one of the steering shaft 410 and the adjustment shaft 406 may be coupled to one of the outer ring 162 and the inner ring 166 of the cam assembly 160 to rotate the outer ring 162 with respect to the inner ring 166. In particular, in one embodiment, the adjustment shaft 406 is coupled to the inner ring 166 to rotate the outer ring 162 with respect to the inner ring 166. The steering shaft 410 (or another component/shaft coupled to the steering shaft 410) may then extend through and be rotatable with respect to the eccentric hole 168 formed through the inner ring 166. Rotation of the adjustment shaft 406 with respect to the steering shaft 410 enables and results in rotation of the outer ring 162 with respect to the inner ring 166 for the directional drilling module 128. The adjustment shaft 406 is then coupled to the cam assembly 160 of the directional drilling module 128 to cause a drill bit 114 to tilt in the intended manner in a target drilling direction. The steering shaft 410 may then be operably coupled to a drive shaft (e.g., steerable shaft 140) and the drill bit 114 such that rotation from the steering shaft 410 may be translated to the drill bit 114 to drill a deviated borehole.

In addition to the embodiments described above, many examples of specific combinations are within the scope of the disclosure, some of which are detailed below:

EXAMPLE 1

An actuation apparatus, comprising:

a housing comprising a housing bore extending through the housing;

an adjustment shaft comprising an adjustment shaft bore extending through the adjustment shaft, the adjustment shaft positioned at least partially within housing bore; and a steering shaft positioned at least partially within the adjustment shaft bore and rotatable with respect to the adjustment shaft.

EXAMPLE 1

An actuation apparatus for use with a directional drilling system that includes a drill bit, the apparatus comprising:

a housing comprising a housing bore extending through the housing;

an adjustment shaft comprising an adjustment shaft bore extending through the adjustment shaft, the adjustment shaft positioned at least partially within housing bore; and a steering shaft positioned at least partially within the adjustment shaft bore and rotatable with respect to the adjustment shaft to adjust a drilling angle of the drill bit.

EXAMPLE 2

The apparatus of Example 1, further comprising a cam assembly for use with the directional drilling system, the cam assembly comprising:

an outer ring with an outer ring eccentric hole formed therethrough;

an inner ring positioned within the outer ring eccentric hole; and wherein the adjustment shaft is coupled to one of the outer ring and the inner ring to rotate the outer ring with respect to the inner ring.

EXAMPLE 3

The apparatus of Example 2, wherein:

the inner ring comprises an inner ring eccentric hole formed therethrough; and the steering shaft extends through the inner ring eccentric hole.

EXAMPLE 4

The apparatus of Example 2, wherein the adjustment shaft rotates the outer ring with respect to the inner ring when the adjustment shaft rotates with respect to the steering shaft.

EXAMPLE 5

The apparatus of Example 1, further comprising a motor to rotate the adjustment shaft with respect to the steering shaft.

EXAMPLE 6

The apparatus of Example 5, further comprising a motion assembly operably coupled between the motor and at least one of the adjustment shaft and the steering shaft to enable the motor to rotate the adjustment shaft with respect to the steering shaft.

EXAMPLE 7

The apparatus of Example 6, wherein:

the motion assembly comprises a sleeve positioned about the steering shaft;

the sleeve is rotationally engaged with the steering shaft such that the sleeve is rotatable with respect to the steering shaft; and the sleeve is rotationally linked to the adjustment shaft such that the sleeve and the adjustment shaft rotate together.

EXAMPLE 8

The apparatus of Example 7, wherein the sleeve and the steering shaft comprise threaded engagement therebetween to rotationally engage the sleeve with the steering shaft.

EXAMPLE 9

The apparatus of Example 7, wherein the sleeve and the adjustment shaft comprise a spline therebetween to rotationally link the sleeve to the adjustment shaft.

EXAMPLE 10

The apparatus of Example 7, wherein the motor axially moves the sleeve with respect to the steering shaft.

EXAMPLE 11

The apparatus of Example 10, wherein the motion assembly further comprises a nut operably coupled between the motor and the sleeve to axially move the sleeve with respect to the steering shaft.

EXAMPLE 12

The apparatus of Example 1, further comprising a bearing assembly positioned between the housing and the adjustment shaft.

EXAMPLE 13

The apparatus of Example 1, further comprising the drill bit operably coupled to the steering shaft.

EXAMPLE 14

A method to drill with a directional drilling system, the method comprising:

rotating an adjustment shaft with respect to a steering shaft, the steering shaft positioned within an adjustment shaft bore of the adjustment shaft; and adjusting a drilling angle of a drill bit operably coupled to the steering shaft as the adjustment shaft rotates with respect to the steering shaft.

EXAMPLE 15

The method of Example 14, further comprising:

rotating an outer ring with respect to an inner ring of a cam assembly as the adjustment shaft rotates with respect to the steering shaft, the inner ring positioned within an outer ring eccentric hole of the outer ring and the adjustment shaft coupled to one of the outer ring and the inner ring

EXAMPLE 16

The method of Example 15, wherein the inner ring comprises an inner ring eccentric hole formed therethrough, the method further comprising rotating the steering shaft within the inner ring eccentric hole.

EXAMPLE 17

The method of Example 15, wherein the rotating the adjustment shaft with respect to the steering shaft causes the rotating the outer ring with respect to the inner ring of the cam assembly.

EXAMPLE 18

The method of Example 14, wherein the rotating the adjustment shaft comprises rotating the adjustment shaft with respect to the steering shaft using a motor.

EXAMPLE 19

The method of Example 18, wherein a motion assembly is operably coupled between the motor and at least one of the adjustment shaft and the steering shaft to enable the motor to rotate the adjustment shaft with respect to the steering shaft.

EXAMPLE 20

A directional drilling system, comprising:

a cam assembly comprising:

an outer ring comprising an outer ring eccentric hole formed therethrough; and an inner ring comprising an inner ring eccentric hole formed therethrough, the inner ring rotatably positioned within the outer ring eccentric hole; an adjustment shaft comprising an adjustment shaft bore extending through the adjustment shaft, the adjustment shaft coupled to one of the outer ring and the inner ring to rotate the outer ring with respect to the inner ring;

a steering shaft positioned at least partially within the adjustment shaft bore and rotatable with respect to the adjustment shaft, the steering shaft extending through the inner ring eccentric hole; and a drill bit operably coupled to the steering shaft such that rotation of the adjustment shaft with respect to the steering shaft adjusts a drilling angle of the drill bit.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. An actuation apparatus for use with a directional drilling system that includes a drill bit, the apparatus comprising:

a housing comprising a housing bore extending through the housing;

an adjustment shaft comprising an adjustment shaft bore extending through the adjustment shaft, the adjustment shaft positioned at least partially within the housing bore;

a steering shaft positioned at least partially within the adjustment shaft bore and rotatable with respect to the adjustment shaft;

a sleeve positioned about and axially moveable with respect to the steering shaft and rotational linked to the adjustment shaft such that the sleeve and the adjustment shaft rotate together; and wherein axial movement of the sleeve relative to the steering shaft rotates the sleeve and the adjustment shaft with respect to the steering shaft to adjust a drilling angle of the drill bit.

2. The apparatus of claim 1, further comprising a cam assembly for use with the directional drilling system, the cam assembly comprising:

an outer ring with an outer ring eccentric hole formed therethrough;

an inner ring positioned within the outer ring eccentric hole; and wherein the adjustment shaft is coupled to one of the outer ring or the inner ring to rotate the outer ring with respect to the inner ring.

3. The apparatus of claim 2, wherein:

the inner ring comprises an inner ring eccentric hole formed therethrough; and the steering shaft extends through the inner ring eccentric hole.

4. The apparatus of claim 2, wherein the adjustment shaft rotates the outer ring with respect to the inner ring when the adjustment shaft rotates with respect to the steering shaft.

5. The apparatus of claim 1, further comprising a motor to rotate the adjustment shaft with respect to the steering shaft.

6. The apparatus of claim 5, further comprising a motion assembly operably coupled between the motor and at least one of the adjustment shaft and the steering shaft to enable the motor to rotate the adjustment shaft with respect to the steering shaft.

7. The apparatus of claim 6, wherein the motion assembly comprises the sleeve.

8. The apparatus of claim 7, wherein the sleeve and the steering shaft comprise threaded engagement therebetween to rotationally engage the sleeve with the steering shaft.

9. The apparatus of claim 7, wherein the sleeve and the adjustment shaft comprise a spline therebetween to rotationally link the sleeve to the adjustment shaft.

10. The apparatus of claim 7, wherein the motor axially moves the sleeve with respect to the steering shaft.

11. The apparatus of claim 10, wherein the motion assembly further comprises a nut operably coupled between the motor and the sleeve to axially move the sleeve with respect to the steering shaft.

12. The apparatus of claim 1, further comprising a bearing assembly positioned between the housing and the adjustment shaft.

13. The apparatus of claim 1, further comprising the drill bit operably coupled to the steering shaft.

14. A method to drill with a directional drilling system, the method comprising:

rotating an adjustment shaft with respect to a steering shaft by moving a sleeve axially with respect to the steering shaft, the steering shaft positioned within an adjustment shaft bore of the adjustment shaft and the sleeve rotationally linked to the adjustment shaft such that the sleeve and the adjustment shaft rotate together; and adjusting a drilling angle of a drill bit operably coupled to the steering shaft as the adjustment shaft rotates with respect to the steering shaft.

15. The method of claim 14, further comprising rotating an outer ring with respect to an inner ring of a cam assembly as the adjustment shaft rotates with respect to the steering shaft, the inner ring positioned within an outer ring eccentric hole of the outer ring and the adjustment shaft coupled to one of the outer ring or the inner ring.

16. The method of claim 15, wherein the inner ring comprises an inner ring eccentric hole formed therethrough, the method further comprising rotating the steering shaft within the inner ring eccentric hole.

17. The method of claim 15, wherein the rotating the adjustment shaft with respect to the steering shaft causes the rotating the outer ring with respect to the inner ring of the cam assembly.

18. The method of claim 14, wherein the rotating the adjustment shaft comprises rotating the adjustment shaft with respect to the steering shaft using a motor.

19. The method of claim 18, wherein a motion assembly is operably coupled between the motor and at least one of the adjustment shaft and the steering shaft to enable the motor to rotate the adjustment shaft with respect to the steering shaft.

20. A directional drilling system, comprising:

a cam assembly comprising:

an outer ring comprising an outer ring eccentric hole formed therethrough; and an inner ring comprising an inner ring eccentric hole formed therethrough, the inner ring rotatably positioned within the outer ring eccentric hole;

an adjustment shaft comprising an adjustment shaft bore extending through the adjustment shaft, the adjustment shaft coupled to one of the outer ring or the inner ring to rotate the outer ring with respect to the inner ring;

a steering shaft positioned at least partially within the adjustment shaft bore and rotatable with respect to the adjustment shaft, the steering shaft extending through the inner ring eccentric hole;

a drill bit operably coupled to the steering shaft;

a sleeve positioned about and axially moveable with respect to the steering shaft and rotationally linked to the adjustment shaft such that the sleeve and the adjustment shaft rotate together; and wherein axial movement of the sleeve relative to the steering shaft rotates the sleeve and the adjustment shaft with respect to the steering shaft to adjust a drilling angle of the drill bit.

* * * * *